US006147331A

United States Patent [19]

Still et al.

[11] Patent Number: 6,147,331

[45] Date of Patent: Nov. 14, 2000

[54] BAND HEATER

[75] Inventors: Christopher G. Still, Smitheville, Mo.; Thomas A. Bothwell, Pahrump, Nev.

[73] Assignee: Heatron, Inc., Leavenworth, Kans.

[21] Appl. No.: 09/363,608

[22] Filed: Jul. 29, 1999

[51] Int. Cl.[7] ..... H05B 3/06

[52] U.S. Cl. ..... 219/525; 219/535

[58] Field of Search ..... 219/520, 525, 219/524, 532, 534, 535, 536; 338/303; 392/459

[56] References Cited

U.S. PATENT DOCUMENTS 2,959,661 11/1960 Bothwell et al. ..... 219/535

5,667,712 9/1997 Sutorius et al. ..... 219/535

*Primary Examiner*—Tu Ba Hoang

*Attorney, Agent, or Firm*—Shughart Thomson & Kilroy P.C.

[57] ABSTRACT

A band heater includes a shoe assembly comprising a plurality of arcuate shoe segments each having a pair of outwardly-projecting extensions and a channel segment formed between the extensions. A strap assembly generally encircles the shoe assembly for retaining same in a circular configuration on an object to be heated. The strap assembly includes opposite side edges which are captured in slots formed by the shoe segment extensions. The strap assembly is thus retained generally within a continuous, annular channel formed by the shoe assembly. The strap assembly side edges can slide longitudinally within the shoe segment extension slots whereby relative movement, for example, due to thermal expansion and contraction, is accommodated. A thermal control unit, such as a tubular electric resistance heater, is located generally within the shoe assembly for conductivity heating same and is generally covered by the strap assembly.

15 Claims, 4 Drawing Sheets

BAND HEATER

BACKGROUND OF THE INVENTION

1. Field of the Invention

The present invention relates generally to heating devices, and in particular to a band heater with a strap assembly longitudinally slidably mounted on a shoe assembly for accommodating thermal expansion and contraction.

2. Description of the Prior Art

Various types of thermal control devices have been produced to accommodate a wide variety of heating and cooling system applications. Band heaters comprise a class of thermal control devices. They are characterized by their annular configurations designed for encircling objects to be heated and cooled. Typical band heater applications include heating the barrels of extrusion and injection molding machinery, heating blown film dies, and heating other cylindrical objects. Prior art band heaters have also been employed for cooling objects on which they are mounted. For applications which require both heating and cooling, prior art band heaters have been provided with both coolant-conveying cooling tubes and electrical heating elements.

A problem commonly encountered in designing band heaters relates to securely clamping them on the objects being heated and cooled. A common band heater design includes an annular shoe assembly comprising multiple, discrete shoe segments. The shoe assembly is retained in place encircling the barrel of an object to be heated or cooled by an annular strap assembly. Prior art strap assemblies include screw-type mechanical fasteners for exerting inwardly-directed radial forces whereby the shoe assemblies could be securely clamped in heat-exchange relationships with the cylindrical object barrels.

A common problem with previous band heaters relates to slippage between the shoe assemblies and the strap assemblies thereof. Such relative slippage can be caused by thermal expansion and contraction as the band heater components heat up and cool down. The practice of using different metals and alloys for the shoe and clamp assemblies tends to contribute to the relative slippage problem. For example, a typical design includes aluminum shoe segments and a stainless steel strap assembly. However, aluminum, with its higher coefficient of thermal expansion, expands up to five times faster than steel. Thus there is a need for a band heater design which accommodates such differential thermal expansion and contraction.

A prior art solution for mounting strap assemblies on shoe assemblies involves tapping the shoe segments to receive screws for mounting the strap assembly. However, this design often presented assembly problems, particularly with relatively large band heaters of up to 72 inches in diameter. Moreover, screw-mounted strap assemblies were not well-adapted to accommodate differential thermal expansion and contraction.

Heretofore there has not been available a band heater with the advantages and features of the present invention. The present invention addresses the aforementioned problems with prior art band heaters.

SUMMARY OF THE INVENTION

In the practice of the present invention, a band heater is provided which includes a shoe assembly comprising a plurality of discrete segments joined together in an annular configuration. The shoe segments are arcuate in shape for collectively forming a circular shoe assembly and have outwardly-projecting extensions along each side which form a continuous, outwardly-open channel in the assembled shoe assembly. Each extension forms a slot which opens transversely inwardly to the channel. A band assembly includes band segments which are connected together at their ends to provide an annular configuration corresponding to the configuration of the shoe assembly. The band assembly includes opposite side edges captured in the shoe segment extension slots. The strap assembly is longitudinally slidable with respect to the shoe assembly to accommodate relative movement therebetween. A thermal control unit can comprise, for example, a tubular electrical resistance heater mounted on or within the shoe assembly with the band assembly in covering relation thereover. With the thermal control unit installed and the strap assembly in place, the band heater can be installed on a piece of equipment in two or more hingedly-connected, semi-circular halves. Fasteners are provided for securing the band heater halves together and clamping them tightly onto a piece of equipment.

OBJECTS AND ADVANTAGES OF THE INVENTION

The principal objects and advantages of the present invention include: providing a band heater; providing such a heater with a multi-segment shoe assembly; providing such a heater with a strap assembly overlying the shoe assembly; providing such a heater which accommodates relative movement between the shoe and strap assemblies; providing such a heater which can be fabricated from different metals with different thermal expansion coefficients; providing such a heater which simplifies assembly and installation; providing such a heater which is adaptable for various objects to be heated; providing such a heater which can be placed in production relatively easily using standard manufacturing techniques; and providing such a heater which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
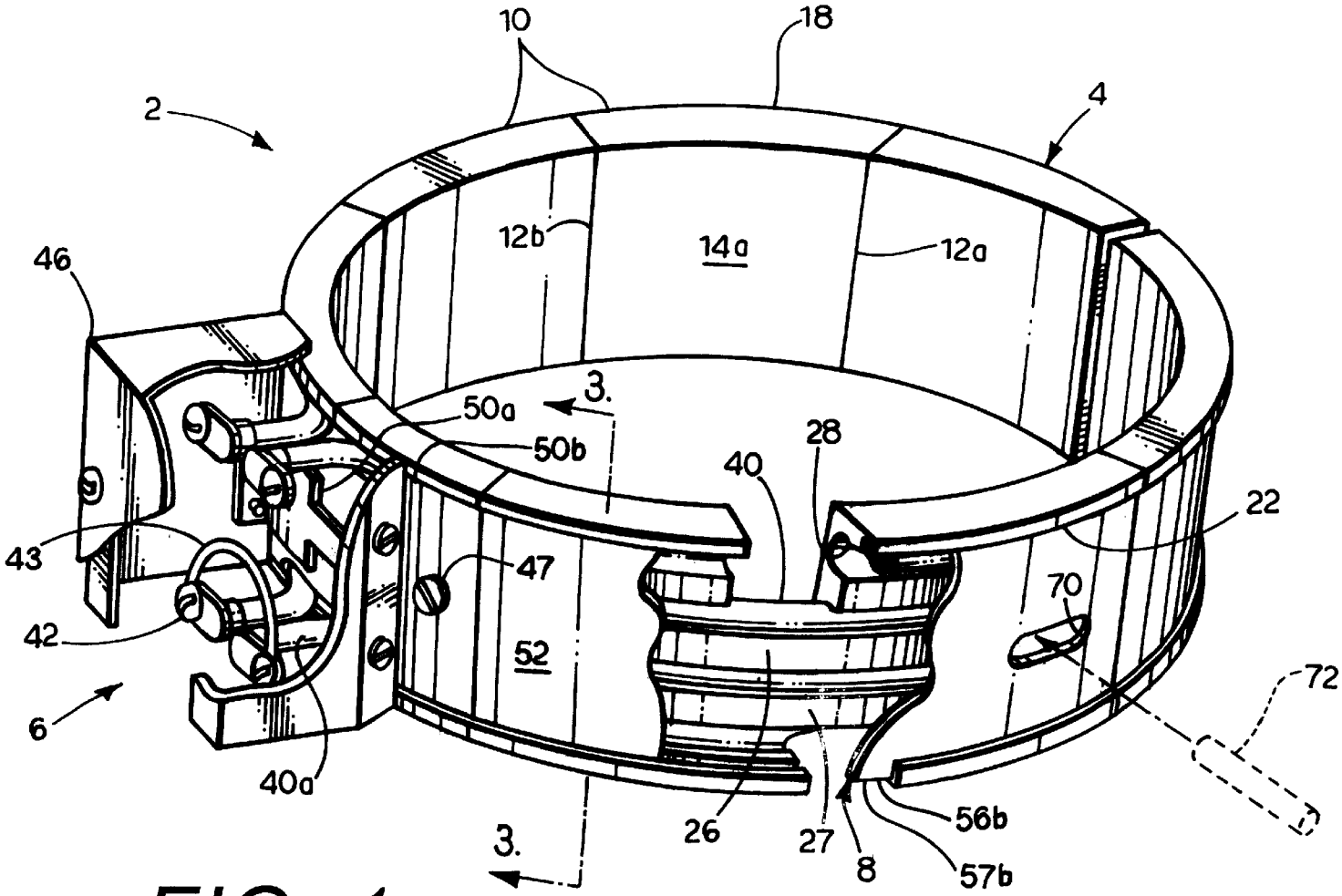
FIG. 1 is a perspective view of a band heater embodying the present invention.
Figure 2:
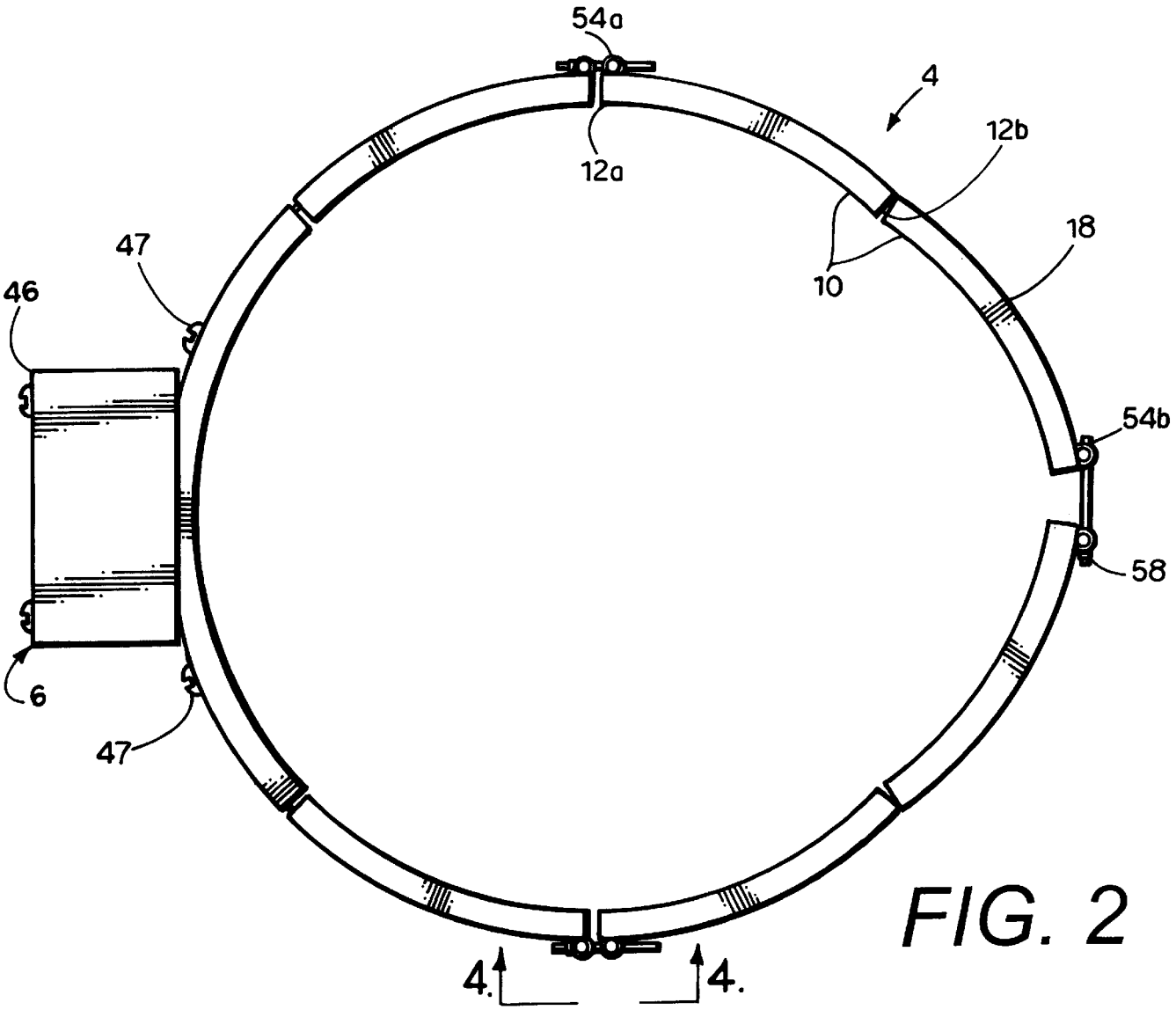
FIG. 2 is a top plan view thereof.

I. Introduction and Environment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a band heater embodying the present invention. The band heater 2 generally comprises a shoe assembly 4, a thermal control assembly 6, and a strap assembly 8.

II. Shoe Assembly 4.

The shoe assembly 4 includes a plurality of shoe segments 10 each having first and second ends 12*a,b;* inner and outer surfaces 14*a,b;* and a pair of opposite side walls 18. A pair of extensions 22 project outwardly from the outer surface 14*b* and extend between the segment ends 12*a,b* whereby a channel 26 is defined by the shoe segment outer surface 14*b* and the extensions 22. The channel 26 is open radially outwardly and extends between and is open at the shoe segment ends 12*a,b*. The channels 26 of the individual shoe segments 10 align to form a substantially continuous, annular channel 27.

Each extension 22 includes a spacer 23*a* extending radially outwardly from the segment outer surface 14*b* and a return 23*b* extending transversely inwardly towards the channel 26 from the spacer 23*a* whereby a slot 24 is formed between the segment outer surface 14*b* and the return 23*b*. The slot 24 opens transversely inwardly to the channel 26. Each shoe segment 10 includes a pair of slots 24 positioned in opposed relation and open along opposite sides of a respective channel 26.

An array 28 of subchannels 30 communicates with the channel 26. Each subchannel 30 extends longitudinally between and is open at the shoe segment ends 12*a,b,* and is also open radially outwardly at the shoe segment outer surface 14*b*. The subchannels 30 of the array 28 extend in generally parallel, spaced relation longitudinally with respect to the shoe segment 10.

III. Thermal Control Assembly 6.

The thermal control assembly 6 comprises a pair of thermal control elements 40 each forming approximately half of a circle. Each element 40 can comprise, for example, a fully-annealed, steel-sheathed, tubular heater with a nickel-chromium ("nichrome") electrical resistance heating wire. A pair of end terminals 42 are provided for attachment to electrical leads (not shown) from an electrical power source within a suitable junction box 46 (FIG. 1). A jumper wire 43 can connect two of the four end terminals 42 whereby two tubular heaters 40 can be connected in series. A wide variety of other thermal control elements 40 can be employed with the present invention, including other heating devices and cooling tubes. For example, tubular elements can be employed which pass hot or cold fluid therethrough for either heating or cooling a structure on which the band heater 2 is mounted.

Figure 3:
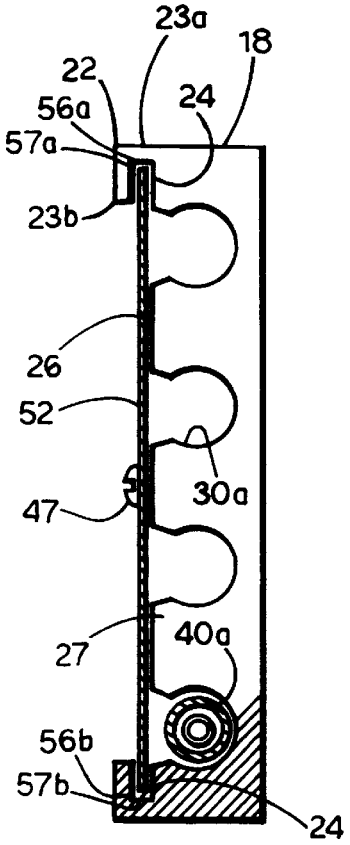
FIG. 3 is a transverse, cross-sectional view thereof, taken generally along line 3—3 in FIG. 1.
Figure 5:
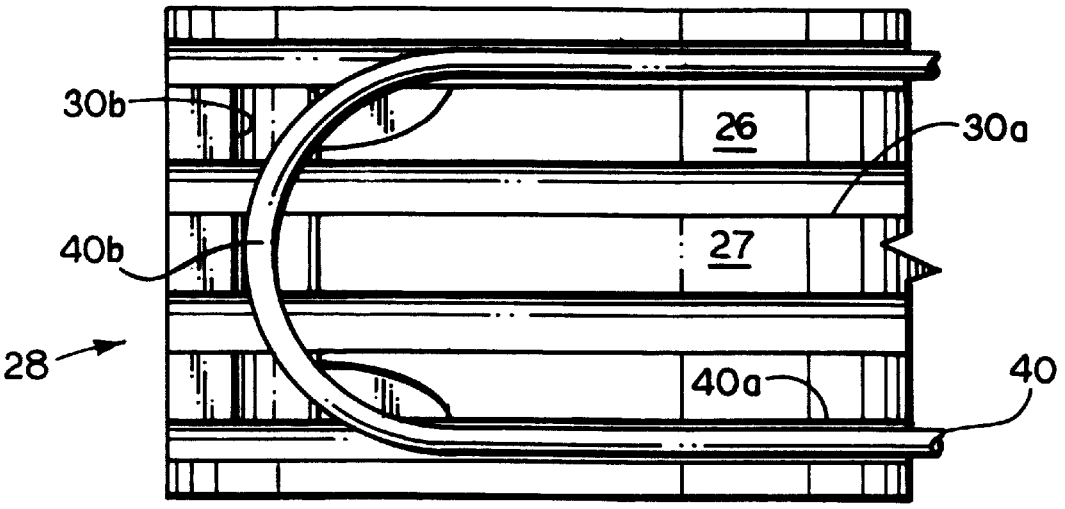
FIG. 5 is an enlarged, fragmentary, side elevational view thereof, particularly showing a U-bend in a tubular, electrical resistance heater mounted in a shoe segment.

The thermal control element 40 is bent to a suitable configuration for placement in the subchannel array 28 formed by the shoe segments 10 in their assembled, annular configuration. For example, the element 40 can be bent double, quadruple, etc. By doubling the elements 40 back on themselves, their terminals 42 can be located in proximity to each other within the junction box 46 whereby power connections can be simplified. The shoe assembly 4 of the band heater 2 includes four subchannel runs 32*a* for accommodating a thermal control element (tubular heater) 40 which is bent quadruple to form four individual control element runs 40*a* each received in a respective subchannel run 30*a* (FIG. 3). The shoe segments 10 can be provided with suitable transverse connecting subchannels 30*b* where appropriate to receive U-bends 40*b* of the elements 40 (FIG. 5).

The end terminals 42 are mounted on outwardly-bent tubular heater end sections 40*c* and can comprise a wide variety of suitable electrical or fluid connectors. In addition to electrical current, the energy-conveying means employed by the thermal control elements 40 can comprise, for example, steam, chilled water, circulating refrigerants, etc.

IV. Strap Assembly 8.

The strap assembly 8 includes first and second ends 50*a,b*. The strap assembly 8 also includes a suitable number (e.g., four are shown) of strap segments 52 with first and second ends 54*a,b* and opposite side margins 56*a,b*. With the strap assembly 8 assembled, the strap segment side margins 56*a,b* collectively form strap assembly side margins 57*a,b*. The strap segment and strap assembly side margins 56*a,b* and 57*a,b* respectively are captured in the aligned shoe segment extension slots 24 whereby the strap assembly 8 is transversely retained in the continuous channel 27 (FIG. 3). However, the strap assembly 8 has the ability to slide longitudinally in the continuous channel 27 to accommodate thermal expansion and contraction of the shoe assembly 4.

The strap segments 52 are held together at respective ends 56*a,b* thereof by suitable fastener or tensioner subassemblies, such as the barrel nut and screw fastener subassemblies 58 as shown. Each fastener subassembly 58 includes stirrups 60 mounted on the strap member ends 56*a,b*. The barrel nut fastener subassemblies 58 permit flexure of the strap segments 52 relative to each other, and also allow the length (i.e., circumference when formed in a circle) of the entire strap assembly 8 to be adjusted, thereby providing means for controlling the tension on the strap assembly 8. Tightening and loosening the barrel nut subassemblies 58 respectively compresses and expands the band heater 2. Each faster subassembly 58 includes a pair of stirrups 60 each mounted on a respective strap segment end 54*a,b*. Each stirrup 60 receives a barrel nut 61. The barrel nuts 61 are interconnected by a screw 62 for tightening and loosening the fastener subassembly 58 for respectively compressing and expanding the band heater 2.

An elongated opening 70 is formed in one of the strap segments 52 and is adapted for longitudinally slidably receiving a component such as a thermocouple 72, which can be mounted on the shoe assembly 4 or equipment on which the band heater 2 is installed. The elongated slot 70 accommodates relative movement of the shoe and strap segments 10, 52 as the individual metal components of the band heater 2 expand and contract as they heat up and cool down. A pair of mounting screws 47 mount the strap assembly 8 to the shoe assembly 10 on either side of the junction box 46.

V. Modified Embodiment Band Heaters 102 and 202.

Figure 6:
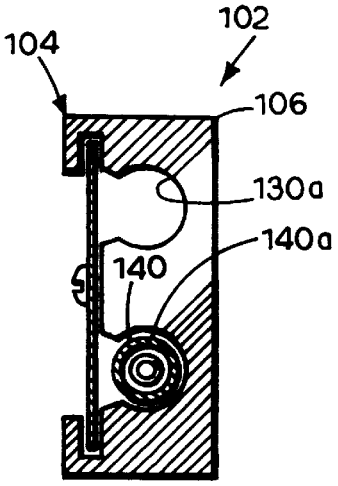
FIG. 6 is a transverse, cross-sectional view of a band heater comprising a first modified embodiment of the present invention.

A band heater 102 comprising a first modified embodiment of the present invention as shown in FIG. 6 and includes a shoe assembly 104 comprising shoe segments 106 each having a pair of subchannel runs 130*a*. A thermal control element 140 includes a pair of runs 140*a* each received in a respective subchannel run 130*a*. The thermal control element 140 can be bent double to form a "hairpin" configuration.

Figure 7:
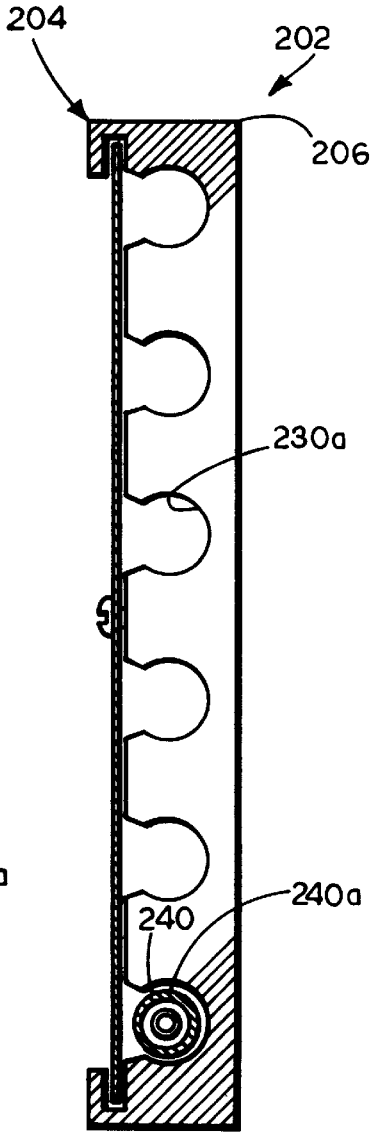
FIG. 7 is a transverse, cross-sectional view of a band heater comprising a second modified embodiment of the present invention.
Figure 4:
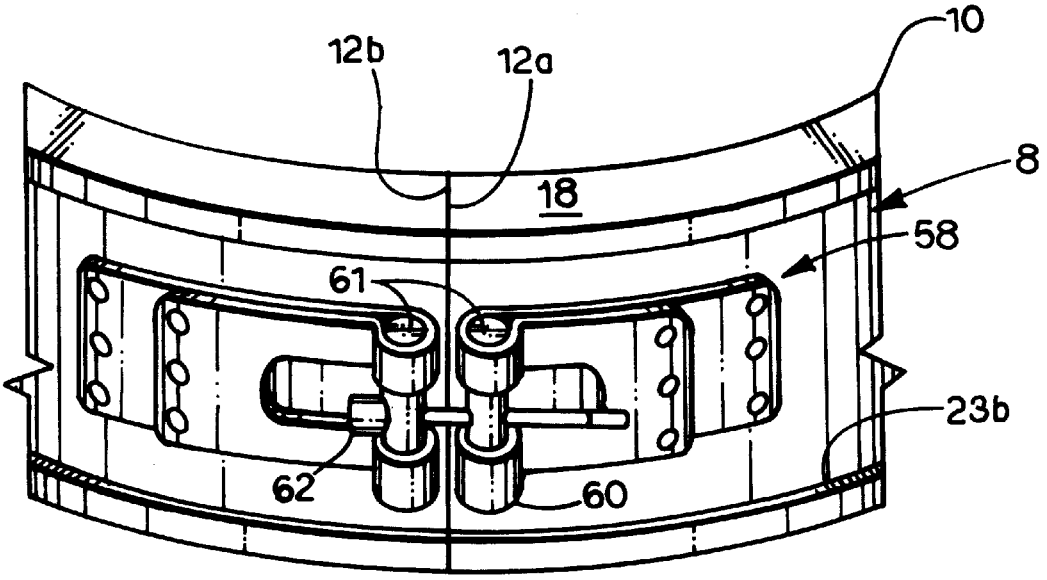
FIG. 4 is a fragmentary, perspective view thereof, particularly showing a barrel nut tensioner subassembly.

A band heater 202 comprising a second modified embodiment of the present invention as shown in FIG. 7 and includes a shoe assembly 204 comprising a plurality of individual, discrete shoe segments 206. Each shoe segment 206 includes 6 subchannel runs 230*a*. A thermal control element 240 includes a plurality of runs 240*a* each received in a respective subchannel run 230*a*.

The shoe assembly and the thermal control element can be formed in various other configurations to satisfy the design requirement of particular applications It is to be understood that while certain forms of the present invention have been illustrated and described herein, it is not to be limited to the specific forms or arrangement of parts described and shown.

What is claimed and desired to be secured by Letters Patent is as follows:

1. A band heater comprising:

a) a shoe segment including:

1) a first end;

2) a second end;

3) an inner surface;

4) an outer surface;

5) a pair of side walls;

1) a pair of extensions projecting outwardly from said outer surface and extending between said shoe segment ends in generally parallel, spaced relation;

2) an annular channel formed by said outer surface and by said extensions; and 3) each said extension forming a slot open to said channel;

b) a thermal control element located generally between said shoe segment side walls in contact with said shoe segment;

c) an annular strap assembly including a strap segment with first and second ends, inner and outer surfaces, and opposite strap margins, each said strap margin being received in a respective shoe segment slot; and a) a strap tensioner connected to said strap assembly ends and adapted for tensioning said strap assembly.

2. The band heater according to claim 1, which includes:

a) said shoe segment including a subchannel extending longitudinally between said segments ends and open at said segment outer surface; and b) said thermal control element comprising a tubular heater positioned in said segment subchannel.

3. The band heater according to claim 1, which includes:

a) a plurality of shoe segments positioned in end-to-end relationship with aligned slots, channels and subchannels, said shoe segments forming a generally annular shoe assembly.

4. The band heater according to claim 3, which includes:

a) a plurality of strap segments each including first and second strap segment ends;

b) said strap segments being positioned in end-to-end relationship around the shoe assembly outer surface; and c) said strap tensioner being connected to respective ends of a pair of said strap segments.

5. The band heater according to claim 1 wherein said shoe segment includes a subchannel open at said segment outer surface and extending between said segment ends, said subchannel receiving a tubular heater.

6. The band heater according to claim 5 wherein said shoe segment includes a plurality of subchannels, said subchannels collectively forming a subchannel array.

7. The band heater according to claim 6 wherein:

a) said subchannel array includes a connecting subchannel extending between a pair of subchannels; and b) said tubular heater includes a U-bend received in said connecting subchannel.

8. The band heater according to claim 1, which includes:

a) a tubular heater having a pair of outwardly bent end sections and a pair of electrical conductor ends terminals each mounted on a respective end section.

9. The band heater according to claim 7, which includes:

a) send sections and end terminals being located in an electrical junction box.

10. The band heater according to claim 7, which includes:

a) a pair of tubular heaters each including four runs and extending approximately halfway around said band heater.

11. The band heater according to claim 1, which includes:

a) said strap segment having an elongated opening; and b) a thermal couple extending through said elongated opening and connected to said shoe segment.

12. The band heater according to claim 1 wherein said strap tensioner includes:

a) a barrel nut and screw fastener subassembly.

13. The band heater according to claim 11 wherein said fastener subassembly includes:

a) a pair of stirrups each mounted on a respective strap member end;

b) a pair of barrel nuts each received in a respective stirrup; and c) a screw extending between and threadably interconnecting said barrel nuts.

14. A band heater comprising:

a) a shoe assembly comprising a plurality of shoe segments each including:

1) a first end;

2) a second end;

3) an inner surface;

4) an outer surface;

5) a pair of side walls;

6) a pair of extensions projecting outwardly from said outer surface and extending between said shoe segments ends and generally parallel, spaced relation;

7) a channel segment formed by said outer surface and by said expansions, said channel segments of said shoe segments being generally aligned to form a substantially continuous, annular channel;

8) each said extension including a spacer located adjacent to a respective side wall and projecting radially outwardly from said outer surface;

9) each said extension also including a respective return extending transversely inwardly from said spacer, said return being positioned in spaced relation from said outer surface whereby a slot is formed therebetween, said slot being opened to said channel;

10) a subchannel array including a plurality of subchannels extending longitudinally between said shoe segments ends and open at said segment outer surface;

b) at least one of said shoe segments including a connecting subchannel extending between a pair of said subchannel runs;

c) a tubular heater including a plurality of longitudinally extending runs each received in a respective segment subchannel run and a U-bend received in said connecting subchannel;

d) said tubular heater having a pair of outwardly-bent end sections and a pair of end terminals each mounted on a respective end section;

e) an annular strap assembly including a plurality of strap segments, each said strap segment including:

1) a first end;
2) a second end;
3) an inner surface;
4) an outer surface;
5) a pair of opposite strap margins, each said strap margin being received in a respective shoe segment slot;

f) a strap fastener connected to a pair of said strap segment ends and connecting same; and g) a strap tensioner subassembly including:

1) a pair stirrups each mounted on a respective strap segment end;
2) a pair of barrel nuts each received in a respective stirrup a screw threadably interconnecting said barrel nut.

15. A band heater comprising:

a) a shoe segment including:

1) a first end;
2) a second end;
3) an inner surface;
4) an outer surface;
5) a pair of side walls;
1) a pair of extensions projecting outwardly from said outer surface and extending between said shoe segment ends in generally parallel, spaced relation;
2) an annular channel formed by said outer surface and by said extensions;
3) each said extension forming a slot open to said channel; and
4) a subchannel extending longitudinally between said ends and open at said segment outer surface;

b) a tubular heater positioned in said segment subchannel;

c) an annular strap assembly including at least one strap segment with inner and outer surfaces, first and second ends, and opposite strap margins, each said strap margin being received in a respective shoe segment slot; and a) a strap tensioner connected to said strap assembly ends and adapted for tensioning said strap assembly.

* * * * *